US009897102B2

(12) United States Patent
Wang et al.

(10) Patent No.: US 9,897,102 B2
(45) Date of Patent: Feb. 20, 2018

(54) STRUCTURE IMPROVEMENT OF PUMP CASING WITH PFA LINER

(71) Applicant: ASSOMA INC., Taoyuan (TW)

(72) Inventors: Chin-Cheng Wang, Dongshan Township, Yilan County (TW); Chih-Hsien Shih, Taoyuan (TW); Chih-Kuan Shih, Taoyuan (TW); Yu-Lun Jhang, Kaohsiung (TW); Huan-Jan Chien, Zhudong Township, Hsinchu County (TW); Shu-Yen Chien, Pingtung (TW)

(73) Assignee: ASSOMA INC., Taoyuan (TW)

( * ) Notice: Subject to any disclaimer, the term of this patent is extended or adjusted under 35 U.S.C. 154(b) by 199 days.

(21) Appl. No.: 14/948,988

(22) Filed: Nov. 23, 2015

(65) Prior Publication Data

US 2016/0363130 A1 Dec. 15, 2016

(30) Foreign Application Priority Data

Jun. 12, 2015 (CN) ..... 2015 1 0323478
Jun. 12, 2015 (TW) ..... 104119144 A
(Continued)

(51) Int. Cl.
*F04D 29/02* (2006.01)
*F04D 29/42* (2006.01)
(Continued)

(52) U.S. Cl.
CPC ..... *F04D 29/4286* (2013.01); *F04D 7/06* (2013.01); *F04D 29/026* (2013.01);
(Continued)

(58) Field of Classification Search
CPC .... F04D 7/06; F04D 29/4286; F04D 29/4293; F04D 29/026; F04D 29/628
See application file for complete search history.

(56) References Cited

U.S. PATENT DOCUMENTS 4,722,664 A 2/1988 Wissman
5,895,203 A 4/1999 Klein
2013/0115053 A1* 5/2013 Chien ..... F04D 29/0473 415/122.1

FOREIGN PATENT DOCUMENTS

CN 2482597 Y 3/2002
EP 2589811 A2 3/2002

OTHER PUBLICATIONS

ITT Corporation,Goulds Pumps, Goulds 3298, Chemical Process Pump, Apr. 2014. (www.itt.com), pp. 1-20.
(Continued)

*Primary Examiner* — Justin Seabe
(74) *Attorney, Agent, or Firm* — Muncy, Geissler, Olds & Lowe, P.C.

(57) ABSTRACT

A structure improvement of a pump casing with a Polyfluoroalkoxy (PFA) liner which improves manufacturing efficiency, reduces manufacturing cost and improves yield strength, more particular to keep the stiffness of the shaft support and improve yield of the pump casing. The metal pump casing with the PFA liner used for handling corrosive liquids includes a suction casing with PFA liner, and a volute casing with PFA liner for accommodating an impeller. The volute casing also collects and then ejects the liquid through a discharge. The suction casing with the PFA liner and the volute casing with the PFA liner are separately formed as two workpieces by injection molding process and then assembled to form the pump casing so as to reduce the residual stress applied in the PFA liner.

3 Claims, 8 Drawing Sheets

(30) Foreign Application Priority Data

Sep. 21, 2015 (CN) ..... 2015 1 0602455
Sep. 21, 2015 (TW) ..... 104131197 A

(51) Int. Cl.
*F04D 7/06* (2006.01)
*F04D 29/62* (2006.01)

(52) U.S. Cl.
CPC ..... *F04D 29/4293* (2013.01); *F04D 29/628* (2013.01); *F05D 2230/30* (2013.01); *F05D 2230/90* (2013.01); *F05D 2300/43* (2013.01)

(56) References Cited

OTHER PUBLICATIONS

World Pumps, Magnatex Pumps, Inc. "The Secret is in the lining: the use of fluoropolymer materials for corrosive pumping", Elsevier Science Ltd, Oct. 2001, pp. 1-5.
Universal Mag, "U-Mag Installation, Operation & Maintenance Manual", Innovative Mag-Drive, USA, 2010 (www.innomag.com), pp. 1-56.

* cited by examiner

STRUCTURE IMPROVEMENT OF PUMP CASING WITH PFA LINER

CROSS-REFERENCE TO RELATED APPLICATIONS

This non-provisional application claims priority under 35 U.S.C. § 119(a) on Patent Application No(s). 104119144 filed in Taiwan, R.O.C. on Jun. 12, 2015, Patent Application No(s). 104131197 filed in Taiwan, R.O.C. on Sep. 21, 2015, Patent Application No(s). 201510323478.2 filed in China on Jun. 12, 2015 and Patent Application No(s). 201510602455.5 filed in China on Sep. 21, 2015, the entire contents of which are hereby incorporated by reference.

TECHNICAL FIELD

The disclosure relates to a structure improvement of pump casing with a Polyfluoroalkoxy (PFA) liner which reduces the manufacturing cost, improves the yield of the liner on the large pump case with a suction size, also referred to as suction channel inner diameter, larger than 80 millimeters (mm) or an impeller size, also referred to as impeller outer diameter, larger than 200 mm and improves the structural reliability of the pump at the operation temperature close to 200 degrees Celsius (° C.). More particularly, the disclosure relates to a structure improvement of pump casing with a PFA liner which reduces the tensile stress in the PFA liner during the manufacturing process as well as reduces the residual stress in the PFA liner after the manufacturing process, and therefore the yield of the pump casing with a PFA liner is increased.

BACKGROUND

The conventional metal pump casing with PFA liner is widely used for chemical handling. In structure design, the pump includes either a stationary shaft or a rotary shaft. The supporting method of the stationary shaft includes a double-side-supporting structure or a cantilever supporting structure. In the double-side-supporting structure or the cantilever supporting structure, the triangle front support located in the suction channel and the rear shaft support at the containment shell, which are made of plastic, are used for supporting the front end and the rear end of the stationary shaft, respectively. The strength of the plastic is decreased when the operating temperature rises, and therefore the strength of the triangle front support and that of the blank rear support are decreased accordingly, which makes the stationary shaft crooked and displaced. Moreover, the metal pump casing with the PFA liner for large pumps has some problems about the manufacturing cost and yield. In the manufacturing process, the metal pump casing is secured in the mold, and then the PFA is introduced into the mold and combines with the metal pump casing into a single unit, wherein the metal pump casing usually includes a plurality of dovetail grooves so that the PFA liner can be firmly fixed onto the metal pump casing by the dovetail grooves.

There are three conventional ways, which are the transfer molding, the rotolining and the injection molding, to form the PFA liner on the inner surface of the metal pump casing. In the transfer molding process, the plastic (PFA) is loaded into a preheating chamber, heated, introduced from the preheating chamber through channels into the mold, and then cooled to a solid structure in the mold. The manufacturing cycle of the transfer molding process takes 8 to 12 hours so that the factories prepare several sets of the mold to increase the output per day. However, the high manufacturing cost of the transfer molding due to the long manufacturing time per manufacturing cycle cannot be overcome yet. In the rotolining process, the PFA powder is spread on the inner surface of the closed metal casing. However, without using a mold, the thickness of the liner cannot be precisely controlled, and the lower density of the liner allows higher permeability. Moreover, because the liner on the inner surface of the metal casing is formed by centrifugal force, the front support, located in the center of the pump, cannot be integrally formed with the liner of the casing. Moreover, the liner cannot be formed on the asymmetric volute channel of a centrifugal pump. In the injection molding process, the manufacturing speed is higher than the other ways of forming the liner, and a manufacturing cycle can normally be done in 10 minutes. However, it is improper to manufacture the liner of the large pump casing by the injection molding process, more particular to the liner of the large pump case with a suction size larger than 80 mm or an impeller size larger than 200 mm. Moreover, the liner of the centrifugal pump, in which the direction of the suction channel and the direction of the discharge channel are perpendicular to each other, will result in residual stress due to the interaction of the axial shrinkage stress and the radial shrinkage stress during the molding process. Such residual stress causes the liner to crack and resulting in pump failure. In addition, the residual stress in the liner can be released under high temperature and/or in a highly corrosive environment, and then cracks are generated in the liner. Therefore, the pump with the liner manufactured by injection molding is not suitable for transporting the chemical material at a temperature close to 200° C.

The following prior arts further describe the problems and the potential problems about the shaft supporting structure in the metal pump casing with the PFA liner and the manufacturing of the metal pump casing with the PFA liner.

Document 1

Document 1 is "The secret is in the lining: the use of fluoropolymer materials for corrosive pumping", which is published in October, 2001 at WORLD PUMPS. Document 1, which is about manufacturing problems of the metal pump casing with the PFA liner, points out that manufacturing the liner by transfer molding requires heating the material of the liner and cooling the liner slowly. In addition, document 1 also points out that FTFE material is not suite for manufacturing the liner by transfer molding. The document 1 also points out that manufacturing the liner by rotolining has some difficulties in controlling thickness, density and flatness of the liner because this process does not take place under pressure and is done without a mold. Moreover, the document 1 points out that manufacturing the liner by injection molding is not suitable for manufacturing the large pump casing due to the shrinkage and the residual stress during the molding process.

Document 2

Document 2 is the catalog of the 3298 series product (www.itt.com) published by the American company, ITT Goulds Pumps, in 2014. Document 2, which is about the metal pump casing with the ETFE liner, points out that the ETFE liner is manufactured by rotolining. The figures in the catalog show that the casing includes a suction flange, a suction channel, a casing channel and a discharge flange which are integrally formed. The casing further includes the shaft support which is separately installed in the suction channel. In addition, as shown in the figures of the guide book, the casing channel in the casing does not show the feature that an area variation of the volute in the casing of the centrifugal pump.

Document 3

Document 3 is the guide book of the U-mag series product (www.innomag.com) published by the American company, INNOMAG, in 2010. Document 3, which is about the metal pump casing with the ETFE or PFA liner, points out that the ETFE liner is manufactured by rotolining. The shaft support is on the rear shaft seat, as a cantilever supporting structure. As shown in the figures of the guide book, the casing channel of the casing does not show the feature that an area variation of the volute in the casing of the centrifugal pump, and the casing of the pump does not have the shaft support.

Case 1

Case 1 is the U.S. Pat. No. 4,722,664, Lined corrosion resistant pump, issued in 1988. Case 1 points out that pump casing with the liner made of fluorocarbon polymer is suitable for transporting corrosive liquids. The material property of PFA is similar to PTFE, and can be processed by conventional melt processing techniques. The pump components made by PFA can be operated at temperatures higher than 150° C. However, the liner made of fluorocarbon polymer has two stress sources which are the residual stress generated during the molding process and the coefficient of thermal expansion difference between the PFA liner and the metal casing, wherein the PFA liner has a higher thermal expansion coefficient. In this case, a solution to the cracks generated by the shrinkage of the liner after molding is provided. The solution is that the fluorocarbon polymer is embedded in grooves and meshes to control the shrinking of the liner which generates cracks in the liner. However, the feature in this case is not used in the pump casing with the PFA liner manufactured by the applicant, the Duriron company. As a result, it is obvious that the grooves and the mesh used in this case for fixing the liner is too expensive and the result is similar to the conventional method in which the liner is fixed by dovetail grooves, and therefore the grooves and the mesh used in this case for fixing is not commercialized. In addition, whether injection molding can be used in manufacturing the liner of the large pump casing with a suction size larger than 80 millimeters (mm) or an impeller size larger than 200 mm is not mentioned in this case. The solution for the problem about the residual stress in the liner which is generated by injection molding is not provided in this case, too.

Case 2

Case 2 is the China patent NO. 2482597, Magnetic drive corrosion resistant fluorine plastic liner pump, issued in 2002. Case 2, which is about the metal pump casing with the PFA liner of the magnetic drive pump, discloses the structure of the PFA liner and that the pump casing with the PFA liner is suitable for transporting the corrosive liquid. The shaft support and the suction flange are integrally formed, and the shaft support as well as the suction flange can be detached from the pump casing. Although the shaft support and the suction flange are separated workpieces, the suction channel is not included in the detachable workpiece. Therefore, the area of the inner surface of the pump casing covered by the liner is still large, and the tensile stress in the liner covering the area between the suction channel and the volute channel is not eliminated. Moreover, the stiffness of the shaft support is not strengthened by reinforced material, and the reliability of the pump structure operated at 200° C. is not disclosed in this case.

Case 3

Case 3 is the U.S. Pat. No. 5,895,203, Centrifugal pump having separable, multipartite impeller assembly, issued in 1999. Case 3, which is about the metal pump casing with the plastic liner of the magnetic drive pump, discloses that the triangle front shaft support is a detachable workpiece, but the pump casing still includes the suction flange, the suction channel, the casing channel and the discharge flange. The connecting surface of the shaft support and the pump casing is covered by plastic without any metal having high stiffness or reinforced material connected directly in this case. Moreover, the reliability of the pump structure operated at 200° C. is not disclosed in this case.

Case 4

Case 4 is the EU patent NO. 2589811, Magnetic drive pump, issued in 2013. In Case 4, the inventor discloses a structural improvement of the shaft support in the pump casing with the PFA liner for operating at high temperatures. The stiffness of the plastic is decreased when the operating temperature rises, as well as the stiffness of the plastic shaft support is decreased accordingly, and, therefore, the metal shaft support with the PFA liner which is integrally formed with the pump casing with the PFA liner is provided to fulfill the high stiffness requirement of the shaft support operating at high temperature. Although the metal shaft support in this case solves the problem that the stiffness of the plastic shaft support is decreased at high operating temperatures, the metal shaft support integrally formed with the pump casing needs to be covered by the PFA liner encapsulated completely to isolate the pump casing, avoiding corrosion on the metal shaft support and the metal pump casing by corrosive chemical liquid. Moreover, the direction of the suction channel and the direction of the volute channel or the discharge channel are perpendicular to each other so that the residual stress, which is generated by the interaction of the axial shrinkage tension and the radial shrinkage tension, which come from the shrinkage during the molding process, is concentrated on the area of the thrust ring seat. This phenomenon is especially apparent in larger size pump casings. There is also the shrinkage stress left in the liner covering the shaft support which causes more serious stress concentration on the area of the thrust ring seat. In this case, for small pump casings, there is no crack appearing on the stress concentrated area of the liner after molding and proper heat treatment, however the crack appeared on the liner of the large pump casings which decreases the yield strength of the pump casing liner, especially for pump sizes larger than 3 inches×2 inches×8 inches (80 mm×50 mm×200 mm). In the large pump casing, the area ratio, the liner area on the volute channel compared to the total liner area on the pump casing, is greater. So, the residual stress, generated by the interaction of the axial shrinkage tension and the radial shrinkage tension, is significantly increased and concentrated at the thrust ring seat of the suction area. Therefore the yield strength of the liner covering the inner surface of the large pump casing is decreased even though proper heat treatment is applied on the liner after molding.

Please refer to FIG. 1A, in the prior art, the pump casing 4 is a single workpiece and are usually constructed of stainless steel or cast iron with a PFA liner. The PFA liner covers the inner surface of the pump casing 4. The pump casing 4 includes a suction flange 411, a suction channel 412, a shaft support 413, a volute channel 423, a discharge channel 422, a discharge flange 421 and a volute PFA liner 424. A plurality of dovetail grooves 47 are located on the inner surface of the suction channel 412 and the inner surface of the volute channel 423 for fixing the PFA liner 424. The volute PFA liner 424 includes a suction flange raised face 414*a*, a suction channel liner 414*b*, a shaft support liner 414*c*, a discharge flange raised face 424*a*, a discharge channel liner 424*b* and a volute channel liner 424*c* which are all integrally formed to isolate the metal parts of the pump casing 4 from corrosive liquids. A thrust ring 46 is installed on a thrust ring seat 461 located on the inner surface of the pump casing 4 so as to resist an axial thrust force generated by an impeller (not shown) when the pump is running.

If the PFA liner is manufactured by injection molding, the shrinkage of the liner covering the inner surface of the pump casing is restrained by the complex structure of the pump casing during the molding process. Particularly, the PFA liner covering the thrust ring seat 461 is pulled by an axial shrinkage stress Fa, a radial shrinkage stress Fb and a shrinkage stress Fc, and cracks are generated on the PFA liner covering the thrust ring seat 461. Therefore, the yield of the large pump casing with PFA liner is decreased in this case due to the large residual stress in the PFA liner.

Please refer to FIG. 1B, if the volute PFA liner of the pump casing is manufactured by transfer molding, the cycle of the transfer molding process takes 8 to 12 hours. Therefore, manufacturing the pump casing with PFA liner by transfer molding is uneconomic. If the PFA liner is manufactured by rotolining, the shaft support 414*c* and the volute channel liner 424*c* having the gradually increasing channel area is hard to be formed in right thickness, because the PFA powder covering the inner surface of the shaft support 414*c* and the volute channel liner 424*c* is driven by centrifugal force. Especially, the volute tongue 424*d* cannot be manufactured by rotolining, and the thickness as well as the flatness of the volute PFA liner 424 is difficult to control.

According to the above-mentioned documents, cases and figures, manufacturing the PFA liner of the metal pump casing has the following problems.

Problem 1

Manufacturing the PFA liner of the metal pump casing by transfer molding has a high manufacturing cost and takes a long time per manufacturing cycle.

Problem 2

Manufacturing the PFA liner of the metal pump casing by rotolining is not able to form the shape of volute casing and the surface of the shaft support which is integrally formed with the pump casing.

Problem 3

The PFA liner covering the inner surface of the metal pump casing manufactured by rotolining has low density, and the thickness of the PFA liner is hard to be controlled precisely.

Problem 4

Injection molding is not suitable for manufacturing the PFA liner of the large pump casing because the residual stress left in the PFA liner.

Problem 5

Injection molding is not suitable for manufacturing the PFA liner of the metal pump casing with the shaft support integrally formed with the metal pump casing because the residual stress left in the PFA liner is increased, so that injection molding is also not suitable for manufacturing the PFA liner of the large metal pump casing.

In manufacturing of the PFA liner of the metal pump casing, transfer molding has high manufacturing cost and takes long time per manufacturing cycle; rotolining is not able to form the PFA liner on the inner surface of the volute casing and the surface of the shaft support which is integrally formed with the pump casing, and the thickness of the PFA liner is hard to be controlled precisely. To solve the problems about manufacturing the PFA liner by injection molding such as the problem 4 and the problem 5 mentioned above are provided in the following.

SUMMARY

A structure improvement of pump casing with a Polyfluoroalkoxy (PFA) liner is provided in this disclosure, especially suitable for conventional injection molding method. The structure improvement is in particular to a metal pump casing, which is integrally formed with a shaft support, with a PFA liner, and the pump casing with the PFA liner is suitable for operating at a temperature close to 200° C. The PFA material is characterized as having high corrosion resistance but high shrinkage coefficient during molding process. When the PFA liner covering the pump casing which an metal component is embedded in is manufactured by injection molding, a problem about a large residual stress in the PFA liner needs to be solved, especially the PFA liner of the large pump casing with a suction size larger than 80 millimeters (mm) or an impeller size larger than 200 mm. In a pump casing of a centrifugal pump, the direction of a suction channel and the direction of a volute channel or a discharge channel are perpendicular to each other so that residual stress, which is generated by the interaction of an axial shrinkage tension and a radial shrinkage tension which come from the shrinkage during the molding process, is left in the PFA liner and concentrated on the thrust ring seat of the suction area. There is also a shrinkage stress left in a shaft support liner which causes more serious stress concentration on the thrust ring seat. Moreover, the area ratio, the PFA liner area on a volute channel compare to the total PFA liner area on the pump casing, is increased so that the residual stress generated by the interaction of the axial shrinkage stress and the radial shrinkage stress is significantly increased and concentrating at the thrust ring seat of the suction area. In this disclosure, the pump casing is separated into two isolated workpieces, a suction casing and a volute casing, along a boundary line in which the thrust ring seat is located, and the thrust ring seat is formed by an axial thrust surface of the suction casing and a radial fasten surface of the volute casing together when the suction casing and the volute casing are assembled with each other. A shaft support, which is made by metal, and the suction casing are integrally formed, and a metal mounting surface of the suction casing as well as a metal mounting surface of the volute casing are directly contacted and fixed with each other by screw, so that a suction casing sealing surface is pressed against a volute casing sealing surface and the pump casing is hermetically sealed, In addition, the shaft support connected to the suction casing and extending into the volute casing has high structural stiffness.

In detail, the suction casing includes a suction flange, a suction channel, a shaft support and a suction PFA liner. The suction flange bears the loading of the inlet pipeline. A plurality of dovetail grooves are located on the inner surface of the suction channel so as to clamp the suction PFA liner for resisting a vacuum situation in the suction channel. The suction PFA liner includes a suction flange raised face, a suction casing sealing surface, the suction channel liner covering the suction channel, and a shaft support liner covering the shaft support. The suction PFA liner, having high corrosion resistance, is used to isolate metal parts of the suction casing from corrosive liquids. The volute casing includes a volute channel, a discharge channel, a discharge flange and a volute PFA liner. The volute channel is suitable for accommodating an impeller and collecting the liquid which the impeller works on so as to discharge the liquid through the discharge channel. The discharge flange bears the loading of the outlet pipeline. A plurality of dovetail grooves are located on the inner surface of the volute channel so as to clamp the suction PFA liner for resisting a vacuum situation in the volute channel. The volute PFA liner includes a discharge flange raised face, a discharge channel liner, a volute channel liner, a volute tongue and a volute casing sealing surface. The volute PFA liner, having high corrosion resistance, is used to isolate metal parts of the volute casing from corrosive liquids. After the suction PFA liner and the volute PFA liner are molded by injection molding, respectively, the suction casing and the volute casing are assembled and fixed by screw to form the metal pump casing with the PFA liner.

The followings are the effects of the present disclosure.

First, to solve the area ratio issue, the pump casing is divided into the suction casing with the suction PFA liner and the volute casing with the volute PFA liner, and therefore, for each workpiece, having smaller area, is able to reduce the shrinkage effect of the suction PFA liner and the volute PFA liner after molding. When the PFA liner of the pump casing is manufactured by injection molding, the manufacturing time and the manufacturing cost are reduced; the thickness of the PFA liner is precisely controlled by the mold, and the gradual area increase of the volute channel liner is formed on the inner surface of the volute channel with gradual area increase can be formed.

Second, the axial direction of the suction channel in the suction casing is perpendicular to the radial directions of the volute channel and the discharge channel in the volute casing. Therefore, when the pump casing is divided into two workpieces, the suction casing and the volute casing, an axial shrinkage stress Fa as well as a shrinkage stress Fc are generated in the suction PFA liner, and a radial shrinkage stress Fb is generated in the volute PFA liner extending in a radial direction. As a result, there is no tensile stress between the suction PFA liner and the volute PFA liner which are manufactured separately by injection molding.

Third, the structural stiffness of the shaft support made by metal is maintained.

The structure improvement of pump casing with the PFA liner in this disclosure is applied on manufacturing the PFA liner of the pump casing with a suction size larger than 80 mm or an impeller size larger than 200 mm by injection molding, and the shaft support provided in this disclosure has high structural reliability when the pump is operated at the temperature close to 200° C.

BRIEF DESCRIPTION OF THE DRAWINGS

The present disclosure will become better understood from the detailed description given hereinbelow and the accompanying drawings which are given by way of illustration only and thus are not limitative of the present disclosure and wherein.

DETAILED DESCRIPTION

Figure 1A:
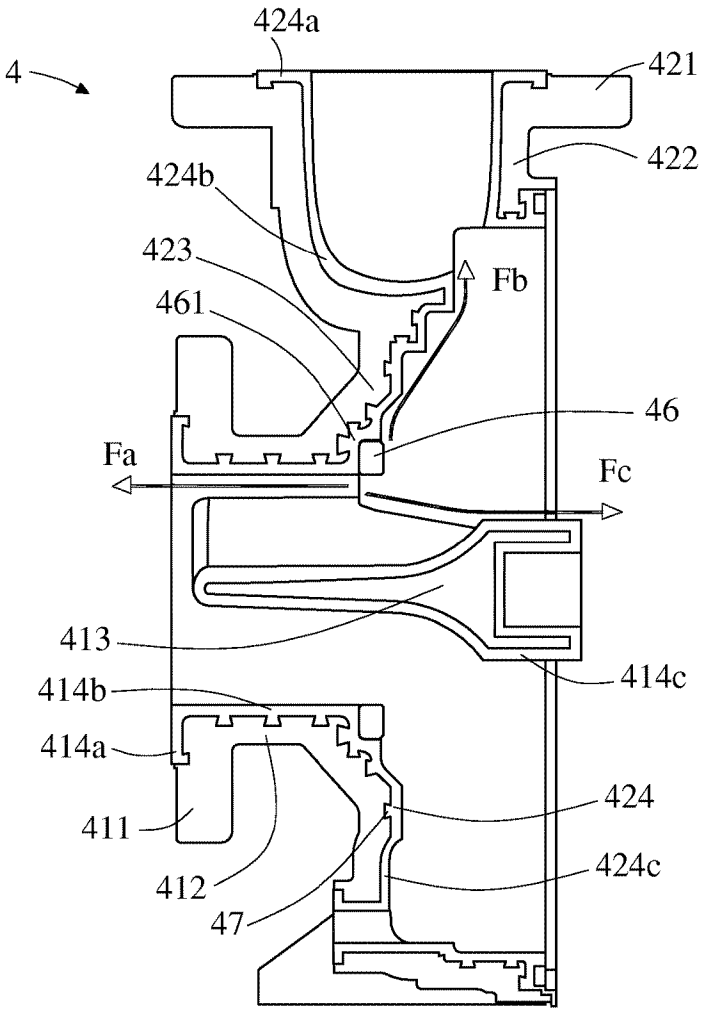
FIG. 1A (Prior Art)
FIG. 1A is a cross-sectional view of a pump casing according to a conventional technique.
Figure 1B:
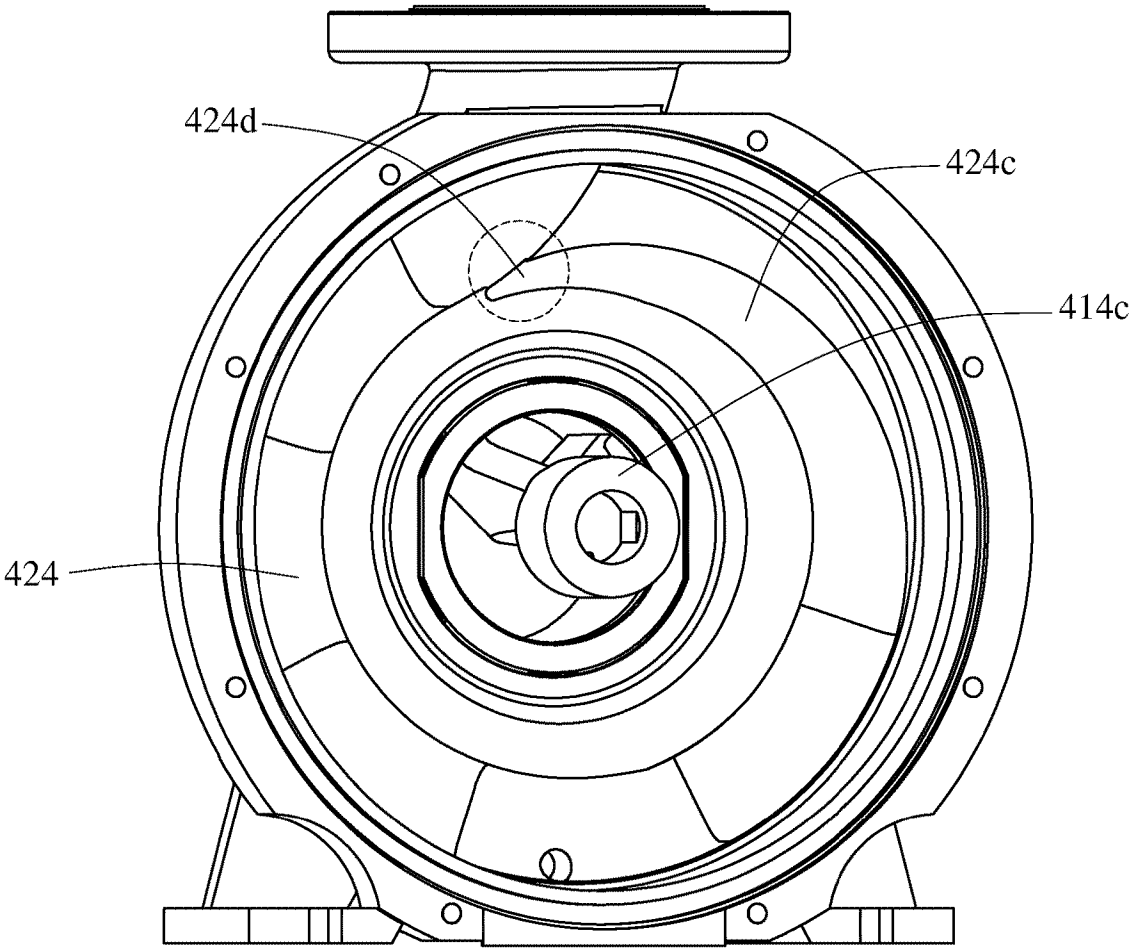
FIG. 1B (Prior Art)
FIG. 1B is a rear view of the pump casing according to the conventional technique.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

In the disclosure, a pump casing made of metal and having a PFA liner is provided. The pump casing includes a suction flange, a suction channel, a shaft support, a volute channel, a discharge channel, a discharge flange and the PFA liner. An inner volume of the pump casing is for accommodating an impeller (not shown). The suction flange is used for connecting with inlet pipeline, and the discharge flange is used for connecting with the outlet pipeline. The shaft support supports one end of the shaft. Liquid flows into the pump casing from the suction channel, and then the shaft power from the motor (not shown) is transferred into the hydraulic power of the liquid by the impeller, and then the liquid flows along the volute channel and out of the pump casing through the discharge channel. A suction flange raised face of the suction flange, a discharge flange raised face of the discharge flange, and all wetted side surface of the pump casing are covered by the PFA liner and all metal parts are isolated from the corrosion liquid.

In the first embodiment of the disclosure, a pump casing with the PFA liner for operating temperature close to 200° C. is provided. The PFA material is characterized as having high corrosion resistance but high shrinkage coefficient during the molding process. When the PFA with a metal component embedded in is manufactured by injection molding, a problem about a large residual stress in the PFA liner needs to be solved, especially for PFA liners of large pump casings with a suction size larger than 80 millimeters (mm) or an impeller size larger than 200 mm.

Please refer to FIG. 2, FIG. 4B, FIG. 5A and FIG. 5B, the supporting method of the stationary shaft in the metal pump casing with the PFA liner is a double-side-supporting structure in the first embodiment of the disclosure. The main components of the metal pump casing with the PFA liner includes a suction casing 41 and a volute casing 42. The suction casing 41, made of cast iron or stainless steel, has an inner surface covered by the PFA liner. The suction casing 41 includes a suction flange 411, a suction channel 412, a shaft support 413 and a suction PFA liner 414. A plurality of dovetail grooves 47 are machined on an inner surface of the suction channel 412. The suction PFA liner 414, which includes a suction flange raised face 414*a*, a suction channel liner 414*b*, a shaft support liner 414*c* and a suction casing sealing surface 416, covering the inner surface of the suction casing 41 is formed by injection molding, and the suction PFA liner 414 is used for isolating the suction casing 41 from corrosive liquids. The volute casing 42, made of cast iron or stainless steel, has an inner surface covered by the PFA liner. The volute casing 42 includes a discharge flange 421, a discharge channel 422, volute channel 423 and a volute PFA liner 424. A plurality of dovetail grooves 47 are machined on an inner surface of the volute channel 423. The volute PFA liner 424, which includes a discharge flange raised face 424*a*, a discharge channel liner 424*b*, a volute channel liner 424*c*, a volute tongue 424*d* and a volute casing sealing surface 428, covering the inner surface of the volute casing 42 is formed by injection molding, and the volute PFA liner 424 is used for isolating the volute casing 42 from the corrosion liquid. A thrust ring 46 is installed on a thrust ring seat 461 located on the inner surface of the pump casing 4 so as to resist an axial thrust force generated by an impeller (not shown) when the pump is running.

Figure 2:
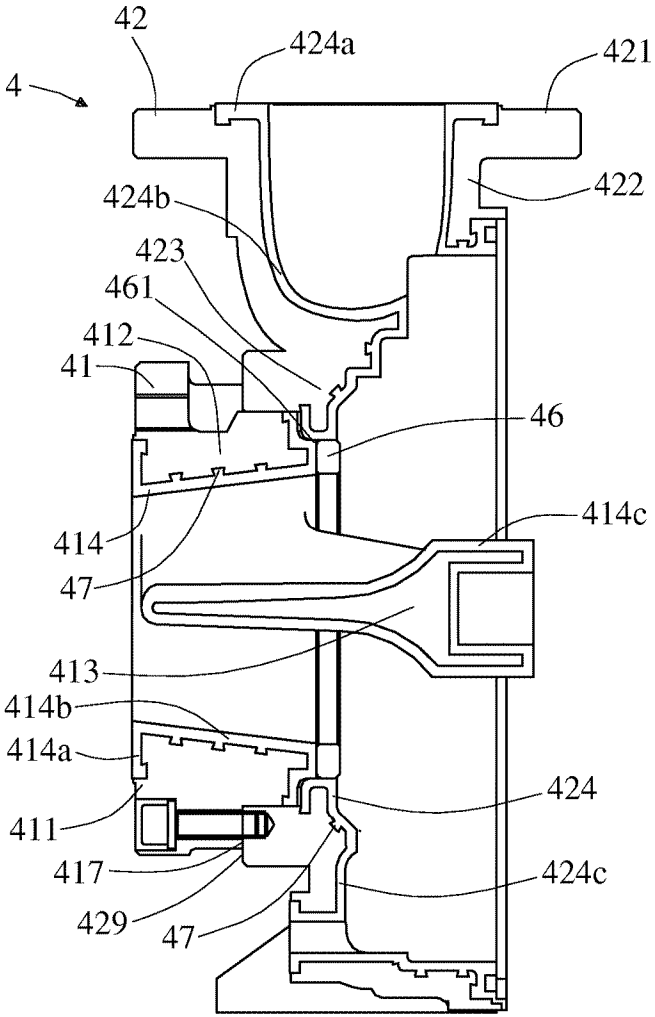
FIG. 2 is a cross-sectional view of a pump casing according to a first embodiment of the disclosure.
Figure 3:
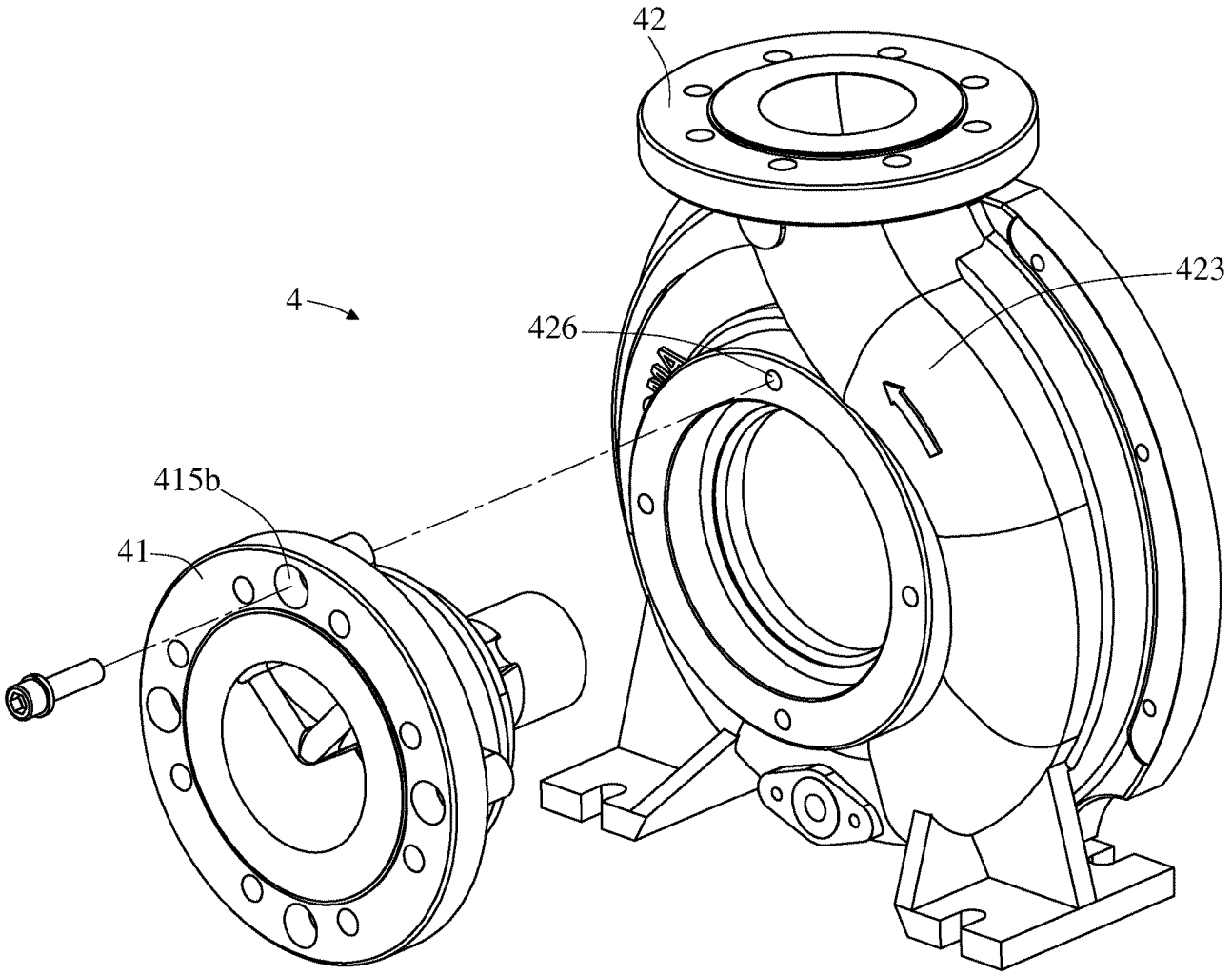
FIG. 3 is an exploded view of the pump casing according to the first embodiment of the disclosure.

Please refer to FIG. 2 and FIG. 3, after the suction PFA liner 414 and the volute PFA liner 424 are formed on the inner surface of the suction casing 41 and the volute casing 42 by injection molding, respectively, the suction casing 41 and the volute casing 42 are assembled and fixed by screws going through bolt holes 415*b* of the suction casing 41 and screwed in screw holes 426 of the volute casing 42 to form the metal pump casing 4 with the PFA liner.

Please refer to FIG. 2, FIG. 4A, FIG. 4B and FIG. 5B, FIG. 4A is a schematic view of a suction casing 41 according to the first embodiment of the disclosure. The suction flange 411, the suction channel 412, the shaft support 413 and the suction PFA liner 414 are located on the front side of the suction casing 41. The suction flange 411 has a set of bolt holes 415*a* which are used for fixing the inlet pipeline (not shown) connected to the suction flange 411. The suction flange 411 also has another set of bolt holes 415*b* which are used for fixing the metal mounting surface 417 of the suction casing 41 to the metal mounting surface 429 at the front end of the volute casing 42 for enforcing the shaft support 413 stiffness, so that the suction casing sealing surface 416 are pressed against the volute casing sealing surface 428 and the pump casing 4 is hermetically sealed. The suction PFA liner 414 includes the suction flange raised face 414*a*, the suction channel liner 414*b*, the shaft support liner 414*c* and the suction casing sealing surface 416 which are integrally formed to isolate the metal parts of the suction casing 41 from the corrosion liquid.

Figure 4A:
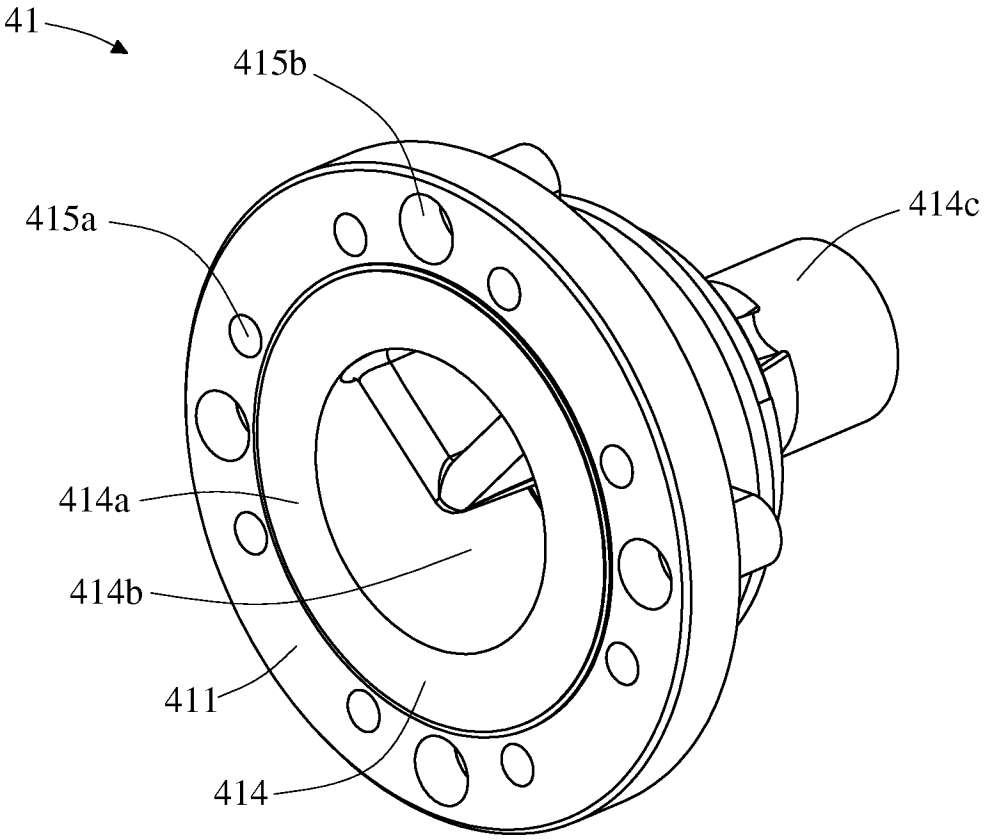
FIG. 4A is a schematic view of a suction casing according to the first embodiment of the disclosure.
Figure 4B:
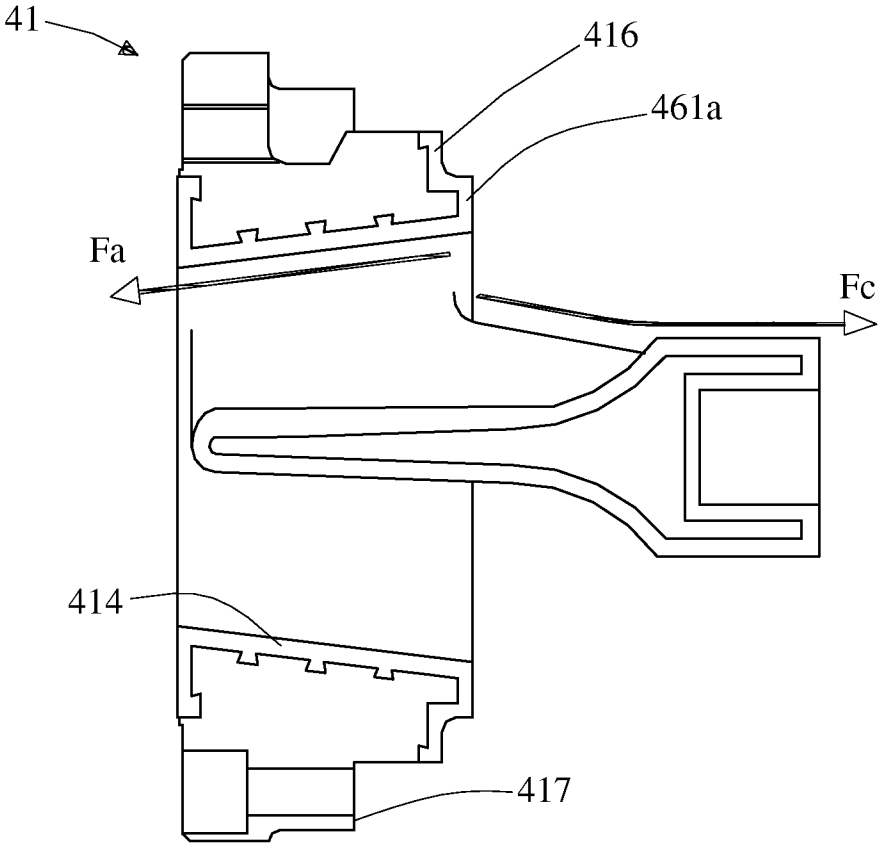
FIG. 4B is a cross-sectional view of the suction casing according to the first embodiment of the disclosure.
Figure 5A:
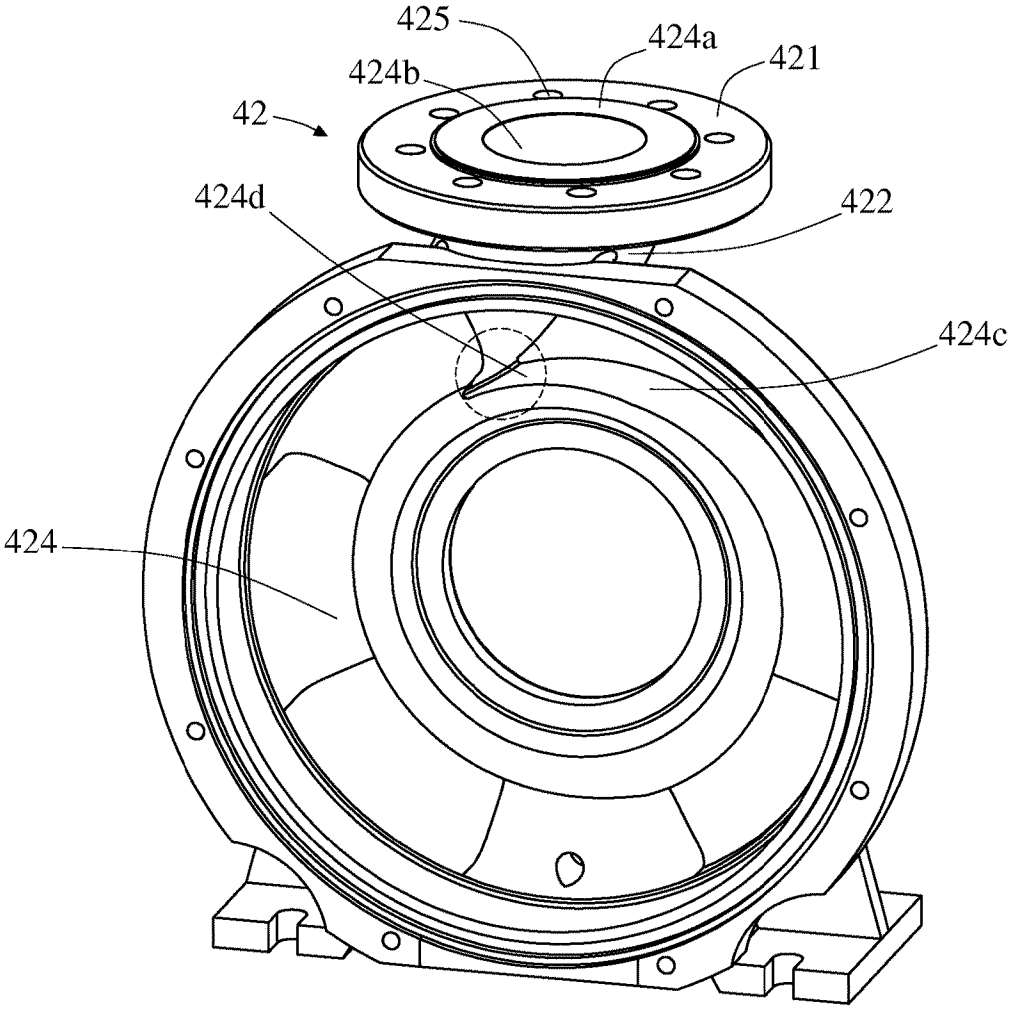
FIG. 5A is a schematic view of a volute casing according to the first embodiment of the disclosure.
Figure 5B:
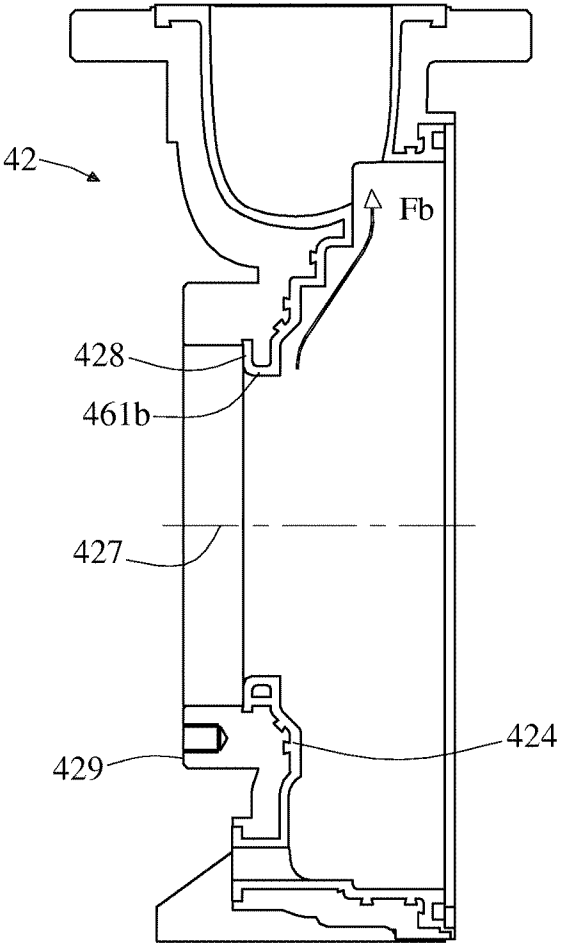
FIG. 5B is a cross-sectional view of the volute casing according to the first embodiment of the disclosure.

Please refer to FIG. 2, FIG. 4B and FIG. 5B, an axial thrust face 461*a* is located on the rear side of the suction casing 41 to form an axial face of the thrust ring seat 461. A suction casing sealing surface 416 is located on the outer side of the axial thrust face 461*a*, and the suction casing sealing surface 416 is connected to the volute casing sealing surface 428 so that the suction casing 41 and the volute casing 42 are sealed by the volute casing sealing surface 428 and the suction casing sealing surface 416 to create a hermetic sealing system. The area of the suction PFA liner 414 is ⅓ to ½ of the area of the PFA liner in the conventional pump casing, and only an axial shrinkage stress Fa as well as a shrinkage stress Fc applies to the PFA liner of the first embodiment relative to the PFA liner in the conventional pump casing. As a result, an economical way to manufacture the PFA liner by injection molding in large pump casing is possible.

Please refer to FIG. 3, FIG. 5A and FIG. 5B, FIG. 5A is a schematic view of a volute casing 42 according to the first embodiment of the disclosure, which includes the volute channel 423, the discharge channel 422, the discharge flange 421 and the volute PFA liner 424. The discharge flange 421 has a plurality of bolt holes 425 which are used for fixing the outlet pipeline (not shown) connected to the discharge flange 421. The front end of the volute casing 42 has a plurality of bolt holes 426 which are used for fixing the suction casing 41. The volute PFA liner 424 includes the discharge flange raised face 424*a*, the discharge channel liner 424*b*, the volute channel liner 424*c*, the volute tongue 424*d* and the volute casing sealing surface 428 which are integrally formed to isolate the metal parts of the volute casing 42 from the corrosive liquids.

Please refer to FIG. 2, FIG. 4B and FIG. 5B, a radial fasten face 461*b* is located on the inner surface of the front central hole 427 in the volute casing 42 to form a radial face of the thrust ring seat 461. A volute casing sealing surface 428 facing the suction casing 41 is connected to the radial fasten face 461*b*, and the volute casing sealing surface 428 is connected to the suction casing sealing surface 416 so that the suction casing 41 and the volute casing 42 are sealed by the volute casing sealing surface 428 and the suction casing sealing surface 416 to create a hermetic sealing system.

Evaluating from the front central hole 427, the area of the volute PFA liner 424 is ½ to ⅔ of the area of the PFA liner in the conventional pump casing, and only a radial shrinkage stress Fb is applied to the PFA liner of the first embodiment relative to the PFA liner in the conventional pump casing. As a result, manufacturing the PFA liner covering the inner surface of the large pump casing by injection molding is more economic, and problems of the tensile stress in the pump liner caused by the complex structure of the pump casing is avoided.

What is claimed is:

1. A pump casing, comprising a suction casing and a volute casing which are formed separately, a suction PFA liner of the suction casing and a volute PFA liner of the volute casing formed separately by injection molding; the suction casing and the volute casing being formed separately by injection molding so as to eliminates a tensile stress between the suction PFA liner and the volute PFA liner and reduces a manufacturing cost of the pump casing by injection molding, wherein:

the suction casing comprises a suction flange, a shaft support, a suction channel and the suction PFA liner integrally, and the suction flange, the shaft support and the suction channel are integrally formed;

the volute casing comprises a volute channel, a discharge channel, a discharge flange and the volute PFA liner integrally; and wherein the suction casing is assembled to the volute casing with a metal mounting surface of the suction casing and a metal mounting surface of the volute casing connected to each other so as to form the pump casing, the shaft support which is integrally formed with the suction flange and the suction channel so as to increase stiffness, and a thrust ring seat is formed by an axial thrust face of the suction casing and a radial fasten face of the volute casing.

2. The pump casing of claim 1, wherein the shaft support and the suction channel are made of cast iron or stainless steel.

3. The pump casing claim 1, wherein the suction casing is assembled to the volute casing by screw.

* * * * *